US007123198B2

(12) United States Patent
Svigelj et al.

(10) Patent No.: US 7,123,198 B2
(45) Date of Patent: Oct. 17, 2006

(54) ELECTRICALLY SMALL WIDEBAND ANTENNA

(75) Inventors: John A. Svigelj, Crystal Lake, IL (US); Giorgi G. Bit-Babik, Sunrise, FL (US); Carlo Di Nallo, Plantation, FL (US); Antonio Faraone, Plantation, FL (US)

(73) Assignee: Motorola, Inc., Schaumburg, IL (US)

( * ) Notice: Subject to any disclaimer, the term of this patent is extended or adjusted under 35 U.S.C. 154(b) by 0 days.

(21) Appl. No.: 11/025,729

(22) Filed: Dec. 22, 2004

(65) Prior Publication Data

US 2005/0280587 A1 Dec. 22, 2005

Related U.S. Application Data

(60) Provisional application No. 60/581,442, filed on Jun. 12, 2004.

(51) Int. Cl.
*H01Q 1/24* (2006.01)

(52) U.S. Cl. ..... 343/702; 343/700 MS

(58) Field of Classification Search ..... 343/700 MS, 343/702

See application file for complete search history.

(56) References Cited

U.S. PATENT DOCUMENTS 3,656,167 A * 4/1972 Lea ..... 343/793
4,443,803 A * 4/1984 DeSantis et al. ..... 343/749
4,570,134 A * 2/1986 Woodward ..... 333/123

* cited by examiner

*Primary Examiner*—Tho Phan

(57) ABSTRACT

An antenna (100) comprises an input port (109, 213) for feeding an electrical signal, a radiating element (220) coupled to the input port that radiates energy of the electrical signal, a second port (110, 211) coupled to the radiating element, a ground structure (214) coupled to the radiating element and second port; and a negative slope reactance circuit (120) characterized by a negative slope of reactance versus frequency, coupled to the second port. The antenna has a wideband frequency range relative to a natural bandwidth of the antenna.

20 Claims, 4 Drawing Sheets

ELECTRICALLY SMALL WIDEBAND ANTENNA

This application is related to U.S. application Ser. No. 10/945,234, filed on Sep. 20, 2004, which claims priority to U.S. Provisional application Ser. No. 60/581,442 filed on Jun. 12, 2004.

FIELD OF THE INVENTION

The present invention relates generally to antennas and in particular to a wideband antenna.

BACKGROUND OF THE INVENTION

Wireless communications technology today requires cellular radiotelephone products that have the capability of operating in multiple frequency bands. The normal operating frequency bands, in the United States for example, are analog, Code Division Multiple Access (CDMA) or Time Division Multiple Access (TDMA) or Global System for Mobile Communications (GSM) at 800 MHz, Global Positioning System (GPS) at 1500 MHz, Personal Communication System (PCS) at 1900 MHz and Bluetooth™ at 2400 MHz. Whereas in Europe, the normal operating frequency bands are Global System for Mobile Communications (GSM) at 900 MHz, GPS at 1500 MHz, Digital Communication System (DCS) at 1800 MHz and Bluetooth™ at 2400 MHz. The capability to operate on these multiple frequency bands requires an antenna structure able to cover at least these frequencies.

External antenna structures, such as retractable and fixed "stubby" antennas (comprising one or multiple coils and/or straight radiating elements) have been used with multiple antenna elements to cover the frequency bands of interest. However, these antennas, by their very nature of extending outside of the radiotelephone and of having a fragile construction, are prone to damage and may be aesthetically unpleasant. As the size of radiotelephones shrink, users are more likely to place the phone in pockets or purses where they are subject to jostling and flexing forces that can damage the antenna. Moreover, retractable antennas are less efficient in some frequency bands when retracted, and users are not likely to always extend the antenna in use since this requires extra effort. Further, marketing studies also reveal that users today prefer internal antennas to external antennas.

The trend is for radiotelephones to incorporate fixed antennas contained internally within the radiotelephone. At the same time, antenna bandwidth and efficiency are fundamentally limited by its electrical size. One known approach to overcome this problem is to use matching networks to match the antenna and source impedances over a specific frequency band. However, if the antenna is narrowband (because of its small size) to begin with, there is only limited increase in bandwidth that can be achieved before serious degradation of the radiated efficiency occurs. Therefore, there is a need for a small size and low cost internal antenna apparatus with multi-band frequency radiation capability. It would also be of benefit to provide this antenna apparatus driven by a single excitation port.

BRIEF DESCRIPTION OF THE DRAWINGS

The present invention is illustrated by way of example and not limitation in the accompanying figures, in which like references indicate similar elements, and in which.

Figure 1:
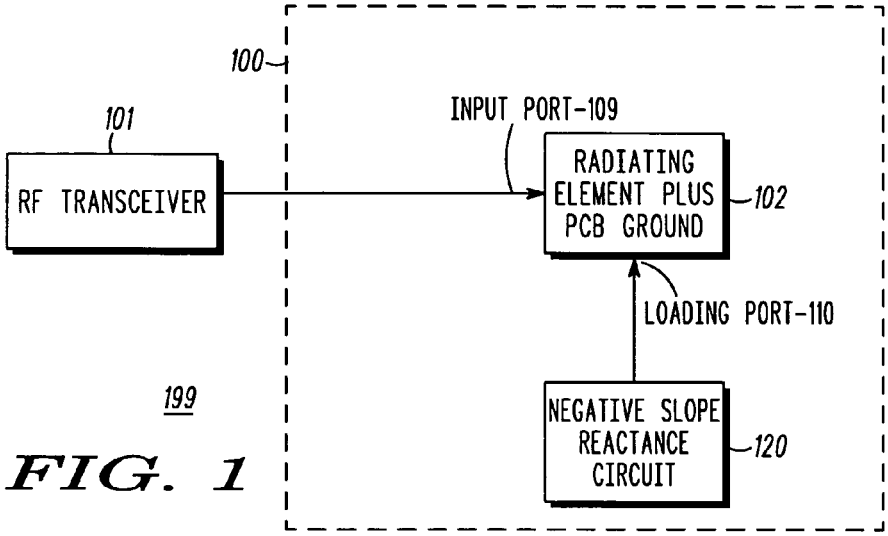
FIG. 1 is a block diagram of an antenna in accordance with some preferred embodiments of the present invention.

Skilled artisans will appreciate that elements in the figures are illustrated for simplicity and clarity and have not necessarily been drawn to scale. For example, the dimensions of some of the elements in the figures may be exaggerated relative to other elements to help to improve understanding of embodiments of the present invention.

DETAILED DESCRIPTION OF THE DRAWINGS

To address the above-mentioned need an antenna is provided having an input port, a loading port and circuit characterized by a reactance having a negative slope with reference to frequency that is coupled to the loading port. In some embodiments, the antenna has a conductive-strip radiating element supported above a substrate via three legs. The substrate incorporates a ground plane formed by a single conductive layer, or by multiple conductive surfaces placed at one or multiple substrate layers, said surfaces being suitably interconnected to perform the same electrical function as a single, continuous conductive layer. The three legs are utilized as two antenna ports and a ground contact for the conductive strip. A first leg of the radiating element is used for loading the antenna, while a second leg is used as a ground. A third leg is utilized as an input port for feeding the antenna. A circuit characterized by reactance having a negative slope with reference to frequency is coupled to the loading port/first leg. This antenna impedance is matched to the transceiver impedance over a frequency range that is substantially broader than a natural bandwidth of the antenna when an optimum passive reactance is coupled to the loading port.

The disclosed antenna structure can be used, for example, in Software Defined Radio applications where the antenna can be used over a wide frequency range without switching between different tuning loads. Additionally, the above-described antenna can be utilized when the volume provided for the antenna is too small to cover several closely spaced frequency bands simultaneously. In this case, a small wideband antenna structure can be used to cover several bands at a time.

Before describing in detail the particular {invention name} in accordance with the present invention, it should be observed that the present invention resides primarily in combinations of method steps and apparatus components related to {invention name}. Accordingly, the apparatus components and method steps have been represented where appropriate by conventional symbols in the drawings, showing only those specific details that are pertinent to understanding the present invention so as not to obscure the disclosure with details that will be readily apparent to those of ordinary skill in the art having the benefit of the description herein.

In this document, relational terms such as first and second, top and bottom, and the like may be used solely to distinguish one entity or action from another entity or action without necessarily requiring or implying any actual such relationship or order between such entities or actions. The terms "comprises," "comprising," or any other variation thereof, are intended to cover a non-exclusive inclusion, such that a process, method, article, or apparatus that comprises a list of elements does not include only those elements but may include other elements not expressly listed or inherent to such process, method, article, or apparatus. An element preceded by "comprises . . . a" does not, without more constraints, preclude the existence of additional identical elements in the process, method, article, or apparatus that comprises the element.

A "set" as used in this document, means a non-empty set (i.e., comprising at least one member). The term "another", as used herein, is defined as at least a second or more. The terms "including" and/or "having", as used herein, are defined as comprising. The term "coupled", as used herein with reference to electro-optical technology, is defined as connected, although not necessarily directly, and not necessarily mechanically.

Turning now to the drawings, FIG. 1 is a block diagram of antenna 100 in accordance with some preferred embodiments of the present invention. Antenna 100 may be contained completely within a cellular radio telephone or other wireless communication device 199. The wireless communication device comprises a transmission signal generator and receiver, shown as RF transceiver 101, in FIG. 1 that may couple an electrical signal to antenna 100 that is intended to be radiated/received by the antenna 100. As shown, antenna 100 comprises radiating structure 102 formed by a radiating element and a ground plane, and negative slope reactance circuit 120. Negative slope reactance circuit 120 can be realized using active circuits that include at least those generally classified as impedance inverters and gyrators. Thus, antenna 100 could be referred to as an active antenna. Negative slope reactance circuit 120 together with the geometry of radiating structure 102 determine a central operating frequency and an impedance bandwidth of antenna 100. Antenna 100 may exhibit a bandwidth that is typically at least 3 times a natural bandwidth of the antenna. The natural bandwidth of the antenna is defined to be the bandwidth of the antenna when an optimum passive reactance is coupled the loading port 110 instead of the negative slope reactance circuit. No switching of the load coupled to the loading port 110 is necessary.

As is known in the art, a passive load at a loading port of an electrically small antenna could provide a central operating frequency at a frequency that is different than the natural resonance frequency of the radiating element, but having a narrow bandwidth that occurs because the antenna is physically small and because the reactance of a passive network increases with frequency.

Figure 2:
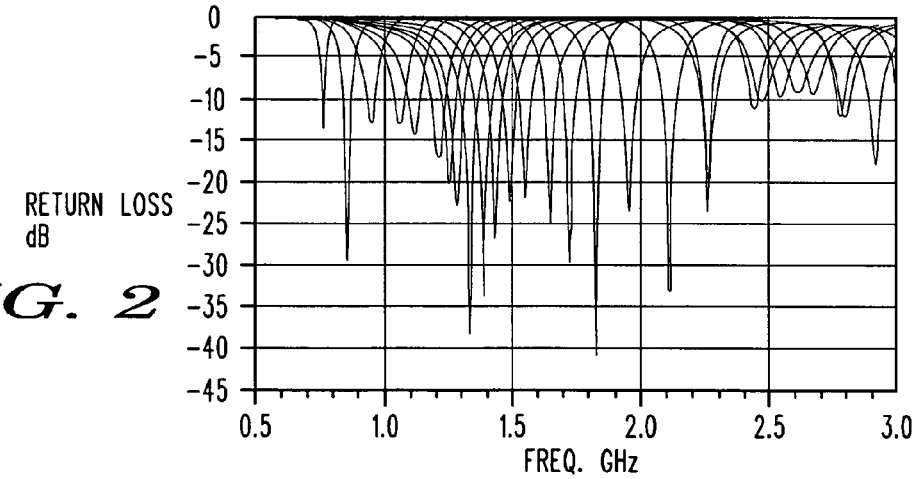
FIG. 2 is a spectral graph that shows an input return loss versus input signal frequency, in accordance with an antenna embodiment in which passive reactances are switchably coupled to the tuning port of the antenna.

Referring to FIG. 2, a spectral graph shows the input return loss versus input signal frequency as determined by computer modeling for an electrically small antenna under operating conditions in which one load of a set of passive loads are switched onto the loading port of the antenna, in accordance with an antenna embodiment in which passive reactances are switchably coupled to the loading port of the antenna. Such an embodiment is described in a co-pending U.S. patent application, Ser. No. 10/945,234, filed on Sep. 20, 2004. It can be seen that by having a large enough set of passive loads, narrowband signals can be transmitted over any frequency in a frequency range from about 1.2 GHz to 2.25 GHz with a return loss less than 10 dB. The bandwidth of each tuned central operating frequency is no more than about 0.1 GHz. The natural bandwidth of this antenna (as used in this document) is that achieved by a passive reactance, and it is about 0.1 GHz in this example.

Figure 3:
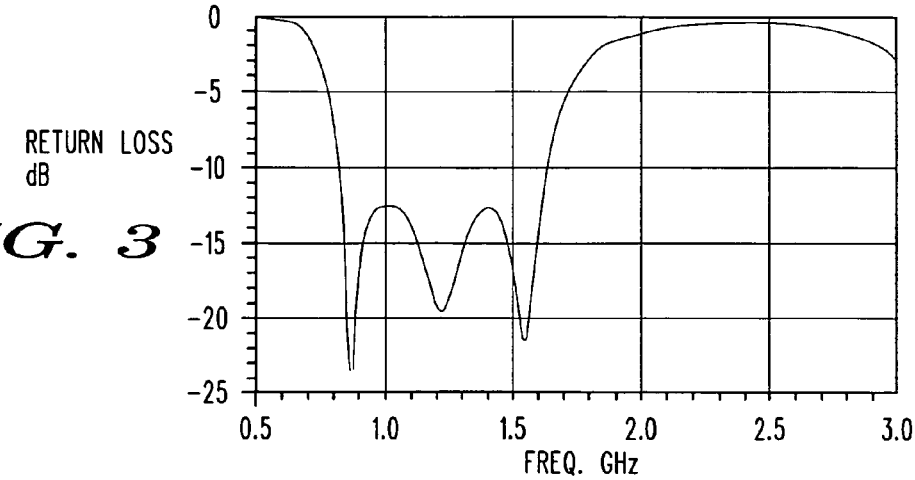
FIG. 3 is a spectral graph that shows the input return loss versus input signal frequency, in accordance with some embodiments of the present invention in which a reactance having a negative slope versus operating frequency is coupled to the loading port of the antenna.

Referring to FIG. 3, a spectral graph shows the input return loss versus input signal frequency as determined by computer modeling for an electrically small antenna having a physical design similar to that modeled for FIG. 2, in accordance with some embodiments of the present invention. The antenna modeled in FIG. 3 is operated under conditions in which a reactance having a negative slope with reference to operating frequency is coupled to the loading port of the antenna. It can be seen that by using reactance having a negative slope, signals can be transmitted over any frequency in a frequency range from about 0.8 GHz to 1.6 GHz with a return loss less than 10 dB. Thus an increase of about 8 times in bandwidth is achieved by using the reactance with a negative slope over the natural bandwidth of the electrically small antenna in this example. Although the bandwidth of the antenna using the reactance with a negative slope is less than an aggregate bandwidth of the switched passive element antenna, it will be appreciated that no switching is needed, and many switched passive loads could be needed in the switched passive element antenna to cover small operating frequency increments. The impedance bandwidth with the negative slope reactive load is continuous, whereas the switched loads provide discrete coverage.

Figure 4:
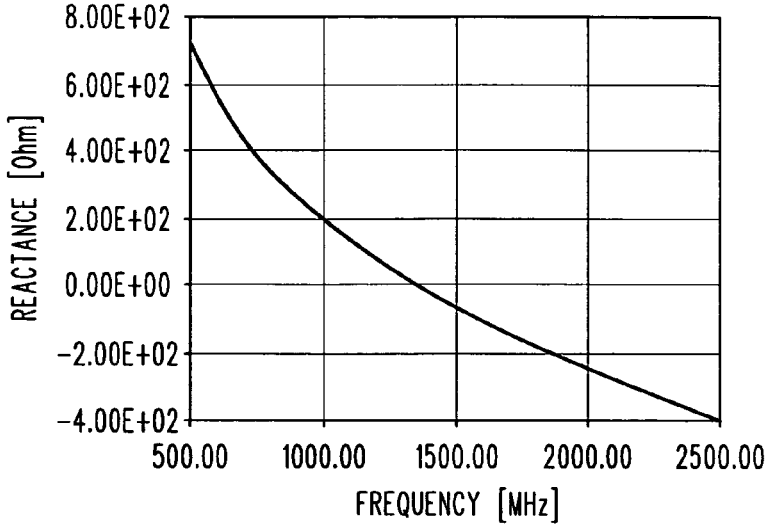
FIG. 4 is a graph of reactance versus frequency for a reactance having a negative slope of the type used in a computer model that generated the spectral graph of FIG. 3.

Referring to FIG. 4, a graph of reactance versus frequency is shown for a reactance having a negative slope of the type used in the computer modeling for the spectral graph of FIG. 3. As can be seen, the reactance decreases with increasing frequency.

Figure 5:
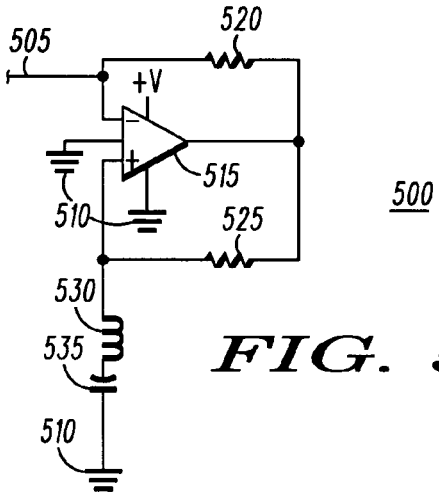
FIG. 5 is an electrical schematic that shows a circuit commonly known as an impedance inverter, in accordance with some embodiments of the present invention.

Referring to FIG. 5, an electrical schematic shows a circuit 500 commonly known as an impedance inverter, in accordance with some embodiments of the present invention. For an electrical signal coupled to the input 505 of circuit 500 and referenced to a ground 510, circuit 500 can be modeled as a reactance that decreases at increasing frequencies. Thus, circuit 500 can be used as the negative slope reactance circuit 120 described with reference to FIG. 1 Circuit 500 comprises an operational amplifier (Op Amp) 515 having an output fed back through resistor 520 to a negative input of the Op Amp 515 and also fed back through resistor 525 to a positive input of the Op Amp 515. The input 505 is coupled to the negative input of the Op Amp 515 and a reactance circuit comprising a series coupling of inductor 530 and capacitor 535 is coupled from the positive input of the Op Amp 515 to a ground 510. A ground 510 is coupled to an offset input of the Op Amp 515. The grounds 510 are common with each other and the ground of the antenna.

Figure 6:
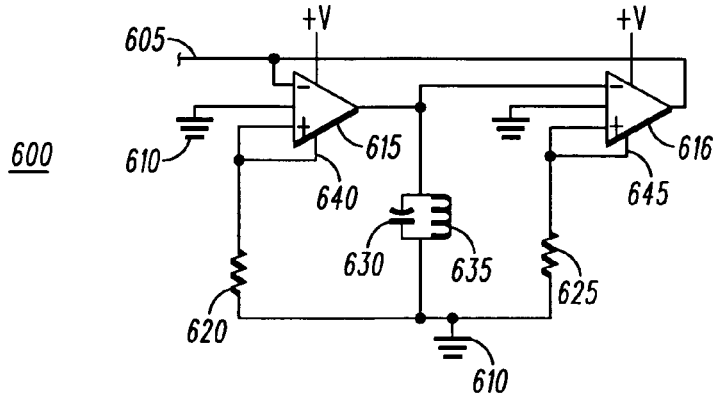
FIG. 6 is an electrical schematic that shows a circuit commonly known as a gyrator, in accordance with some embodiments of the present invention.

Referring to FIG. 6, an electrical schematic shows a circuit 600 commonly known as a gyrator, in accordance with some embodiments of the present invention. For an electrical signal coupled to the input 605 of circuit 600 and referenced to a ground 610, circuit 600 can be modeled as a reactance that decreases at increasing frequencies. Thus, circuit 600 can be used as the negative slope reactance circuit 120 described with reference to FIG. 1. Circuit 600 comprises two operational amplifiers (Op Amps) 615, 616 in which the output of Op Amp 616 is coupled to a negative input of Op Amp 615. The input 605 is coupled to the negative input of the Op Amp 615. A reactance circuit comprising a parallel coupling of capacitor 630 and inductor 635 is coupled from the output of the Op Amp 615 to a ground 610. A ground 610 is coupled to an offset input of the Op Amps 615, 616. For each of Op Amps 615, 616, a respective reference input 640, 645 and a respective positive input are coupled through a respective resistor 620, 625 to a ground 610. The grounds 610 are common with each other and the ground of the antenna.

Figure 7:
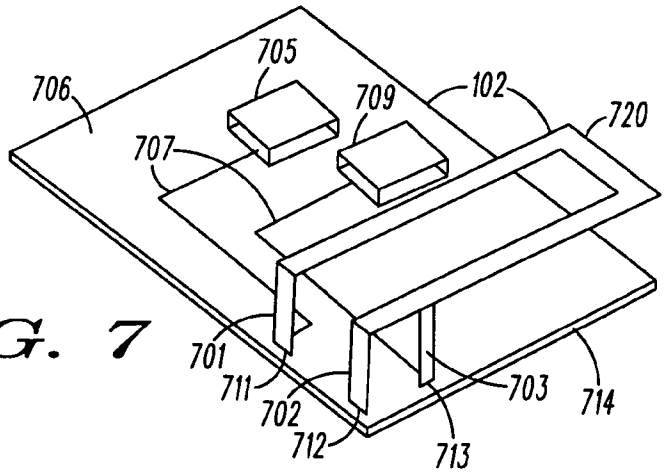

FIG. 7 shows a perspective view of the apparatus described in FIG. 1 according to a first embodiment of the present invention. Radiating structure 102 is shown comprising a conductive-strip, piece of wire, or metal strip 720 located over a ground plane (or ground structure) 714 embedded within substrate 706. The conductive strip 720 in the radiating structure 102 is approximately a quarter wavelength at the lowermost frequency of the bandwidth achieved using the negative slope reactance. Although a bandwidth was described above with reference to FIG. 3 as having limits defined by −10 dB return loss at the input port, the impedance bandwidth could be defined in other ways appropriate to specific uses of the antenna. Substrate 706 preferably comprises a standard printed circuit board (PCB) or ceramic substrate. In the preferred embodiment of the present invention radiating element 720 is folded, taking on a "U-shape" to reduce dimensions. As is evident, radiating element 720 is supported above substrate 706 via legs 701–703. Legs 701–703 electrically contact the ground plane at a first 711, second 712, and third 713 point. First point 711 is utilized as a loading port, while third point 713 is utilized as a feed (or input) port. Second point 712 is utilized as a ground contact. The negative slope reactance circuit 120 shown in FIG. 1 is located within a combined integrated circuits and component part 705 that is attached to substrate 706. Even though FIG. 7 shows separate loading circuitry 705 and feed (or input) circuitry 709 coupled to input port 711/leg 701 and loading port 713/leg 703, one of ordinary skill in the art will recognize that loading and feed circuitry 705 and 709 may be physically combined or separated in a variety of ways.

In the preferred embodiment of the present invention first leg 701 (at first point 711) is used solely as a loading port, while a second leg 702 of radiating element 720 is grounded at point 712. Leg 703 (at point 713) is utilized solely as a feeding port for feeding the RF signal to radiating element 720. Leg 703, and hence point 713 is connected in close proximity to leg 702/point 712 to match radiating structure 102 with the impedance of RF transceiver 101. Typically, all necessary electrical connections between legs 701–703 and circuitry 705 and 709 are made via standard PCB traces 707, even though other techniques, e.g., suspended microstrip line, could be employed to realize the same electrical function. As one of ordinary skill in the art will recognize, traces 707 are not arbitrary in length. Those connected to the loading port 711/leg 701 are part of the loading circuit and contribute to establishing a value of the loading reactance by transforming the reactance seen at one trace terminal to a new reactance value at the other trace terminal.

For all embodiments discussed here and below, the length of conductive strip 720 at which frequency it becomes resonant when loading port 711/leg 701 is grounded is approximately equal to half the radiating wavelength at said frequency. As is known, the effective electrical length of conductive strip 720 may vary depending on the capacitive coupling between the strip 720 and the ground plane 714. For instance, the capacitive coupling may be altered by a dielectric antenna support or cover.

During operation, leg 703 is coupled to RF transceiver 101 at port 713 and receives an RF signal to be radiated. Leg 701 is coupled to negative slope reactance circuit 120 and in operation provides a reactance load that decreases with the instantaneous frequency of the input signal, thus effectively making the antenna a broadband antenna. As described above, ground plane 714 is provided embedded within substrate 706. Radiating element 720 is grounded via leg 702 contacting ground plane 714 at point 712. Loading port 711 (and leg 701) is substantially maximally distal along the path described by radiating element 720 to the feed port 713 (and leg 703) on substrate 706. This is because in this configuration, the loading port can most effectively change the resonant length of the radiating element 720 without affecting significantly the impedance match to the RF transceiver within the operating frequency range of the antenna as much as it would if it were placed significantly closer to the feeding port. The input impedance of the antenna is mainly determined by the radiating element 720, ground plane 714 and the position of the feed leg 703 and grounded leg 702.

Figure 8:
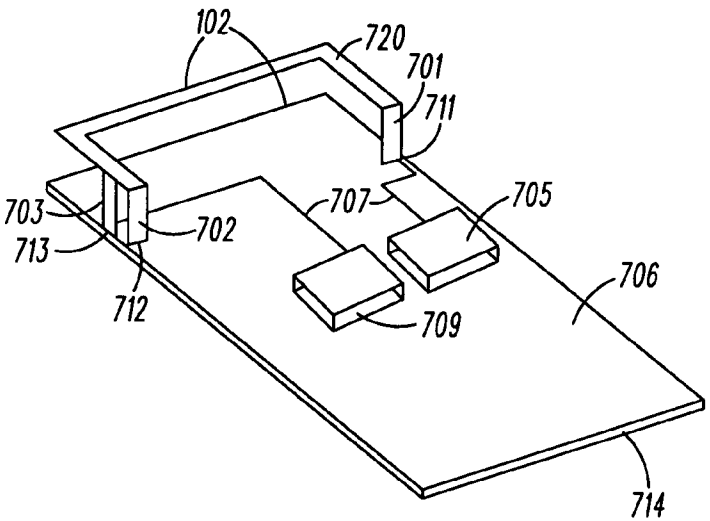
FIGS. 7–11 show perspective views of antenna apparatuses of the present invention according to some embodiments.

FIG. 8 shows a perspective view of the apparatus shown in FIG. 1 according to a second preferred embodiment. As is evident, radiating element 720 is shown comprising a piece of conductive-strip, wire, or metal strip located over ground plane 714 embedded within substrate 706. In the second preferred embodiment radiating element 720 is folded, taking on a "U-shape" to reduce dimensions, with the opening of the "U" being rotated 90 degrees from that shown in FIG. 7. As is evident, radiating element 720 is still supported by three legs 701, 702, and 703, each serving the function set forth above.

Figure 9:
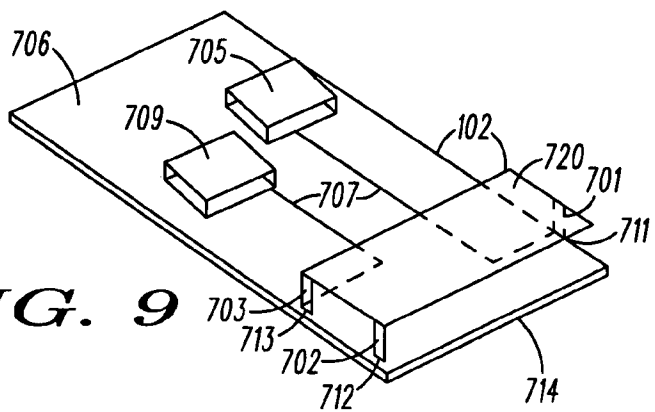

FIG. 9 shows a perspective view of apparatus shown in FIG. 1 according to a third preferred embodiment. In the third preferred embodiment, radiating element 720 comprises a metallic plate that is again suspended above substrate 706, and supported by three legs 701, 702, and 703. As with the above embodiments, legs 701–703 serve solely as a loading port, a ground, and a feed port, respectively at points 711–713, respectively. More particularly, as with all the above embodiments, radiating element 720 is formed utilizing a two-port structure. One port (713) is utilized solely as an antenna feeding port, while another port (711) is utilized solely as a port loaded by a negative-slope reactance circuit and is placed maximally distal from the feeding port along the route of radiating element 720.

It will be appreciated that although the radiating elements described in accordance with the various embodiments of the present invention are electrically small, the realization of a negative slope reactance at the antenna loading port produces a wideband response at the input port. This wideband response can be almost as broadband as the frequency range that can be swept by the tunable antenna structure using a varying passive reactance at the loading port. The limits of the wideband response are due to the antenna impedance at the low end of the frequency range and the change in slope of the negative slope reactance circuit at the high end of the frequency range.

It will be further appreciated that the present invention can provide similar benefits for antennas that are constructed using other than printed circuit or ceramic substrates. For example, the same benefits may apply to a low frequency antenna constructed of a large radiating element (e.g. such as 2 meters long) operating above an aluminum ground structure.

Figure 11:
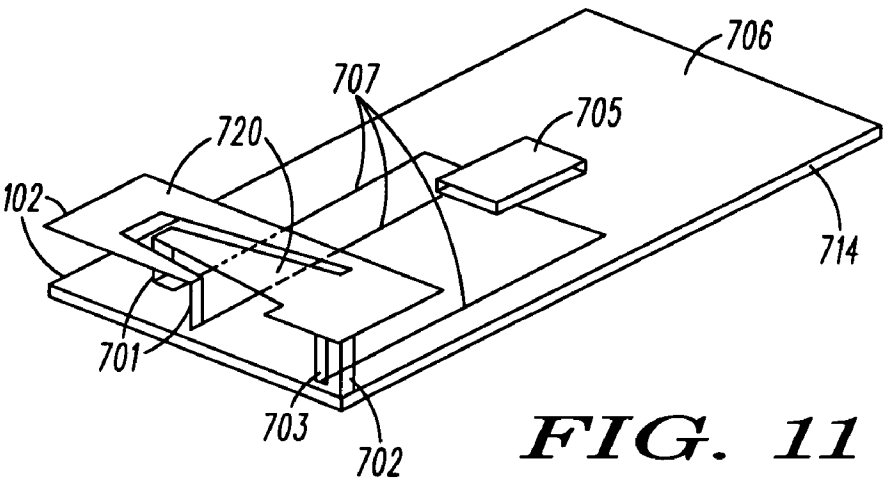
Figure 10:
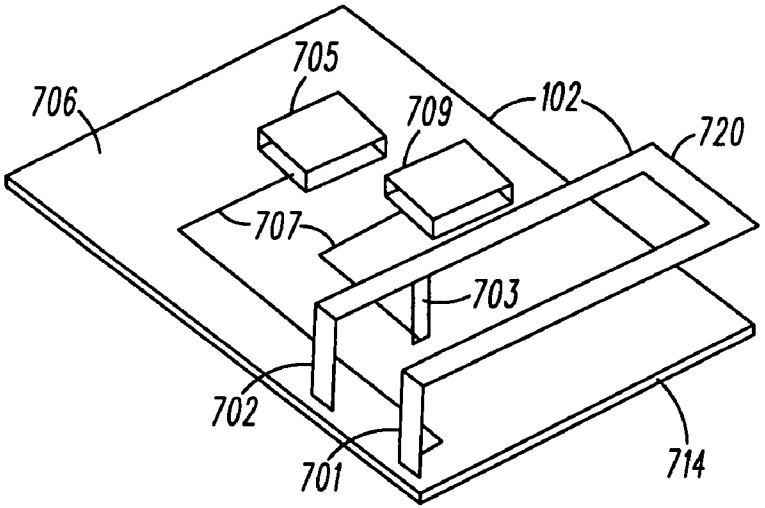

While the invention has been particularly shown and described with reference to a particular embodiment, it will be understood by those skilled in the art that various changes in form and details may be made therein without departing from the spirit and scope of the invention. Some of these changes are shown in FIGS. 10 and 11. It should be noted that reference numerals 711–713 have been omitted from FIGS. 10 and 11 for clarity. The antenna disclosed in FIG. 10 features a structure similar to that in FIG. 7, with the main difference that the loading function performed by port 711/leg 701 and the feeding and grounding functions performed by port 713/leg 703 and port 712/leg 702 are applied on reversed ends of the radiating element 720. The antenna disclosed in FIG. 11 has multiple loading ports at legs 701 that may be utilized to load independently the antenna response in a dual-wide band antenna. This radiating element 720 has the same ground and feeding port described above and has two distinctive radiating parts (arms) responsible mainly for each of two frequency bands. In this case instead of one loading port there exist two loading ports connected to the above-mentioned arms with all the characteristics and negative slope reactance circuits described above. It is intended that such changes come within the scope of the following claims.

The invention claimed is:

1. An antenna, comprising:

an input port for feeding an electrical signal;

a radiating element coupled to the input port that radiates energy of the electrical signal;

a second port coupled to the radiating element;

a ground structure coupled to the radiating element and to the second port; and an active negative slope reactance circuit characterized by a negative slope of reactance versus frequency, coupled to the second port.

2. The antenna according to claim 1, wherein a bandwidth of the antenna is at least three times broader than a natural bandwidth of the antenna.

3. The antenna according to claim 1, wherein a bandwidth of the antenna is at least an order of magnitude times broader than a natural bandwidth of the radiating element.

4. The antenna according to claim 3, wherein the negative slope reactance circuit has the negative slope over a frequency range that is at least three times broader than a natural bandwidth of the antenna.

5. The antenna according to claim 1, wherein the second port is substantially maximally distal to the input port along the radiating element.

6. The antenna according to claim 1, wherein the negative slope reactance circuit is one of an impedance inverter and a gyrator.

7. An antenna, comprising:

an input port for feeding an electrical signal;

a radiating element coupled to the input port that radiates energy of the electrical signal;

a second port coupled to the radiating element;

a ground structure coupled to the radiating element and to the second port; and a negative slope reactance circuit characterized by a negative slope of reactance versus frequency, coupled to the second port, wherein a bandwidth of the antenna is at least an order of magnitude times broader than a natural bandwidth of the radiating element, and wherein the negative slope reactance circuit is an impedance inverter.

8. An antenna, comprising:

an input port for feeding an electrical signal;

a radiating element coupled to the input port that radiates energy of the electrical signal;

a second port coupled to the radiating element;

a ground structure coupled to the radiating element and to the second port; and a negative slope reactance circuit characterized by a negative slope of reactance versus frequency, coupled to the second port, wherein a bandwidth of the antenna is at least an order of magnitude times broader than a natural bandwidth of the radiating element, and wherein the negative slope reactance circuit is a gyrator.

9. An antenna comprising:

a ground plane;

a radiating element electrically coupled to the ground plane at a first, second, and a third point, wherein the first point is utilized as a ground for the radiating element, wherein the second point is utilized as a loading port for the radiating element, wherein the third point is utilized as an input port for the radiating element; and a negative slope reactance circuit coupled to the second point, wherein the second point is substantially maximally distal to the input port along the radiating element.

10. The antenna of claim 9 wherein the negative slope reactance circuit comprises one of an impedance inverter and a gyrator circuit.

11. The antenna of claim 9 wherein the radiating element is supported above the ground plane by first, second, and third legs that terminate at the first, second, and third points.

12. The antenna of claim 9 wherein the radiating element comprises a conductive-strip, piece of wire, or metal strip.

13. The antenna of claim 9 wherein a length of the radiating element is approximately a quarter wavelength at a lowest end of a bandwidth achieved using the negative slope reactance circuit.

14. The antenna of claim 9 wherein the radiating element is folded, taking on a "U-shape".

15. The antenna of claim 9 wherein:

the first point is utilized solely as a ground for the radiating element;

the second point is utilized solely as a loading port for the radiating element; and the third point is utilized solely as an input port for the radiating element.

16. The antenna of claim 9 wherein the radiating element comprises a metallic plate.

17. An antenna comprising:

a ground structure;

a radiating element supported above the ground structure and electrically coupled to the ground structure via a first, second and a third leg;

wherein the first leg is utilized as a ground for the radiating element;

wherein the second leg is utilized as a loading port for the radiating element;

wherein the third leg is utilized as a feed port for the radiating element; and a negative slope reactance circuit coupled to the loading port wherein the second leg is substantially maximally distal to the third leg along the radiating element.

18. A wireless communication device, comprising:

a transmission signal generator; and an antenna coupled to the transmission signal generator, comprising an input port for feeding an electrical signal, a radiating element coupled to the input port that radiates energy of the electrical signal, a second port coupled to the radiating element, and an active negative slope reactance circuit characterized by a negative slope of reactance versus frequency, coupled to the second port.

19. An antenna, comprising:

a radiating element having an input port and a second port, each of which are referenced to a ground, wherein the input port is for feeding an electrical signal that is radiated; and a negative slope reactance circuit characterized by a negative slope of reactance versus frequency, coupled between the second port and the ground.

20. An antenna, comprising:

an input port for feeding an electrical signal;

a radiating element coupled to the input port that radiates energy of the electrical signal;

a second port coupled to the radiating element;

a ground structure coupled to the radiating element and to the second port; and a negative slope reactance circuit characterized by a negative slope of reactance versus frequency, coupled to the second port, wherein the second port is substantially maximally distal to the input port along the radiating element.

* * * * *